US008474076B2

(12) United States Patent
Hornbach

(10) Patent No.: US 8,474,076 B2
(45) Date of Patent: Jul. 2, 2013

(54) ADJUSTABLE FOOT SECTION FOR A PATIENT SUPPORT APPARATUS

(75) Inventor: David W. Hornbach, Brookville, IN (US)

(73) Assignee: Hill-Rom Services, Inc., Batesville, IN (US)

( * ) Notice: Subject to any disclaimer, the term of this patent is extended or adjusted under 35 U.S.C. 154(b) by 167 days.

(21) Appl. No.: 13/021,370

(22) Filed: Feb. 4, 2011

(65) Prior Publication Data

US 2012/0198629 A1 Aug. 9, 2012

(51) Int. Cl.
*A47B 7/00* (2006.01)

(52) U.S. Cl.
USPC ..... 5/624; 5/618; 5/181; 5/657

(58) Field of Classification Search
USPC ..... 5/181, 200.1, 624, 657, 208, 249, 5/251, 507.1, 660, 661, 618
See application file for complete search history.

(56) References Cited

U.S. PATENT DOCUMENTS

| | | | | | |
|---|---|---|---|---|---|
| 262,365 | A | * | 8/1882 | Bulkeley | 5/250 |
| 286,166 | A | * | 10/1883 | Allis | 5/240 |
| 3,003,158 | A | * | 10/1961 | Sevcik | 5/181 |
| 3,220,021 | A | * | 11/1965 | Nelson | 5/618 |
| 3,220,022 | A | | 11/1965 | Nelson | |
| 3,413,663 | A | | 12/1968 | Swann | |
| 3,744,066 | A | * | 7/1973 | Falivene | 5/176.1 |
| 3,893,197 | A | | 7/1975 | Ricke | |
| 4,183,015 | A | | 1/1980 | Drew et al. | |
| 4,409,695 | A | | 10/1983 | Johnston et al. | |
| 4,615,058 | A | * | 10/1986 | Feldt | 5/602 |
| 4,669,136 | A | | 6/1987 | Waters et al. | |
| 4,680,790 | A | | 7/1987 | Packard et al. | |
| 4,700,417 | A | | 10/1987 | McGovern | |
| 4,803,744 | A | | 2/1989 | Peck et al. | |
| 4,805,249 | A | | 2/1989 | Usman et al. | |
| 4,847,929 | A | | 7/1989 | Pupovic | |
| 4,862,529 | A | | 9/1989 | Peck | |
| 4,894,876 | A | * | 1/1990 | Fenwick | 5/602 |
| 4,928,332 | A | * | 5/1990 | Ogden et al. | 5/614 |
| 4,968,013 | A | * | 11/1990 | Kuck | 5/600 |
| 4,985,946 | A | | 1/1991 | Foster et al. | |
| 5,023,967 | A | | 6/1991 | Ferrand | |
| 5,077,843 | A | | 1/1992 | Dale et al. | |

(Continued)

FOREIGN PATENT DOCUMENTS

| | | |
|---|---|---|
| EP | 1 020 146 | 7/2000 |
| EP | 1 296 580 | 4/2003 |
| GB | 2313303 | 11/1997 |
| WO | WO 99/15126 | 4/1999 |

*Primary Examiner* — Michael Trettel
*Assistant Examiner* — Myles Throop
(74) *Attorney, Agent, or Firm* — Barnes & Thornburg LLP

(57) ABSTRACT

A patient support apparatus including a bed frame, an adjustable foot section coupled to a foot end of the bed frame, and a deck moveably coupled to the adjustable foot section. The deck defines a foot support surface having a length dimension defined along a longitudinal axis of the bed frame and a width dimension defined transverse to the longitudinal axis. The length dimension is a first length and the width dimension is a first width when the adjustable foot section is in a first position, and the length dimension is a second length and the width dimension is a second width when the adjustable foot section is in a second position. The second length is less than the first length, and the second width is greater than the first width.

19 Claims, 6 Drawing Sheets

U.S. PATENT DOCUMENTS 5,083,332 A 1/1992 Foster et al.
5,179,744 A 1/1993 Foster et al.
5,345,629 A 9/1994 Ferrand
5,377,370 A 1/1995 Foster et al.
5,398,357 A 3/1995 Foster
5,454,126 A 10/1995 Foster et al.
5,479,666 A 1/1996 Foster et al.
5,542,136 A 8/1996 Tappel
5,542,138 A 8/1996 Williams et al.
5,592,153 A 1/1997 Welling et al.
5,613,255 A * 3/1997 Bish et al. ..... 5/611
5,628,078 A 5/1997 Pennington et al.
5,630,238 A 5/1997 Weismiller et al.
5,715,548 A 2/1998 Weismiller et al.
5,745,936 A 5/1998 Van McCutchen et al.
5,771,511 A 6/1998 Kummer et al.
5,878,452 A 3/1999 Brooke et al.
6,008,598 A 12/1999 Luff et al.
6,089,593 A 7/2000 Hanson et al.
6,131,868 A 10/2000 Welling et al.
6,154,899 A 12/2000 Brooke et al.
6,163,903 A 12/2000 Weismiller et al.
6,182,310 B1 2/2001 Weismiller et al.
6,185,767 B1 2/2001 Brooke et al.
6,185,769 B1 2/2001 Larisey, Jr. et al.
6,212,714 B1 4/2001 Allen et al.
6,226,816 B1 5/2001 Webster et al.
6,279,183 B1 8/2001 Kummer et al.
6,315,319 B1 11/2001 Hanson et al.
6,320,510 B2 11/2001 Menkedick et al.
6,324,709 B1 12/2001 Ikeda et al.
6,336,235 B1 1/2002 Ruehl
6,357,065 B1 * 3/2002 Adams ..... 5/618
6,362,725 B1 3/2002 Ulrich et al.
6,396,224 B1 5/2002 Luff et al.
6,477,726 B2 * 11/2002 Hernandez ..... 5/200.1
6,486,792 B1 11/2002 Moster et al.
6,496,993 B2 12/2002 Allen et al.
6,526,609 B2 3/2003 Wong
6,565,112 B2 5/2003 Hanson et al.
6,611,979 B2 9/2003 Welling et al.
6,658,680 B2 12/2003 Osborne et al.
6,675,415 B2 1/2004 Wong
6,678,908 B2 1/2004 Borders et al.
6,684,427 B2 2/2004 Allen et al.
6,726,279 B1 * 4/2004 Figel et al. ..... 297/340
6,846,042 B2 1/2005 Hanson et al.
6,880,189 B2 4/2005 Welling et al.
7,000,272 B2 2/2006 Allen et al.
7,007,323 B2 * 3/2006 Zerhusen et al. ..... 5/427
7,210,180 B2 5/2007 Malcolm
7,216,384 B2 5/2007 Allen et al.
7,260,860 B2 8/2007 Chambers et al.
7,363,663 B2 4/2008 Chambers et al.
7,406,729 B2 * 8/2008 Hornbach et al. ..... 5/613
7,458,119 B2 12/2008 Hornbach et al.
7,461,425 B2 12/2008 Chambers et al.
7,464,425 B2 12/2008 Chambers et al.
7,520,006 B2 4/2009 Menkedick et al.
7,523,515 B2 4/2009 Allen et al.
7,565,710 B2 7/2009 Chamber et al.
7,568,247 B2 8/2009 Strobel et al.
7,600,817 B2 10/2009 Kramer et al.
7,669,263 B2 3/2010 Menkedick et al.
7,730,562 B2 * 6/2010 Hornbach et al. ..... 5/613
7,743,441 B2 6/2010 Poulos et al.
7,788,748 B2 9/2010 Wurdeman
7,805,782 B2 10/2010 Hakamiun et al.
7,832,039 B2 11/2010 Chambers et al.
7,845,032 B2 12/2010 Chambers et al.
8,104,122 B2 * 1/2012 Richards et al. ..... 5/618
8,177,296 B2 * 5/2012 Shih ..... 297/85 M
2001/0004777 A1 * 6/2001 Hernandez ..... 5/200.1
2001/0044971 A1 11/2001 Borders et al.
2002/0059678 A1 * 5/2002 Hernandez ..... 5/200.1
2003/0088920 A1 * 5/2003 Allen et al. ..... 5/624
2005/0081295 A1 * 4/2005 Malcolm ..... 5/624
2005/0102755 A1 * 5/2005 Jacobs et al. ..... 5/624
2006/0021142 A1 * 2/2006 Hornbach et al. ..... 5/600
2006/0026762 A1 * 2/2006 Hornbach et al. ..... 5/611
2006/0195984 A1 9/2006 Hakamiun et al.
2007/0061971 A1 * 3/2007 DeBraal et al. ..... 5/617
2008/0040857 A1 2/2008 Karmer et al.
2008/0282472 A1 * 11/2008 Hornbach et al. ..... 5/616
2012/0198628 A1 * 8/2012 Richards ..... 5/618

* cited by examiner

ADJUSTABLE FOOT SECTION FOR A PATIENT SUPPORT APPARATUS

BACKGROUND

The present disclosure relates to a patient support apparatus, such as a hospital bed, for supporting a patient. More particularly, the present disclosure relates to a patient support apparatus having an adjustable foot section.

Patient support apparatuses, such as, for example, hospital beds may include sections that are expandable or retractable to vary the size of the deck. For example, a patient support apparatus may include a foot deck section to support the lower legs with the foot deck section being extendable or retractable to act as a foot prop to support the foot of a patient on the patient support apparatus. In patient support apparatuses that move to a chair egress position, such as the Hill-Rom® TotalCare® bed, which is commercially available from the Hill-Rom Company, Inc. of Batesville, Ind., U.S.A., the foot deck section may retract to prevent interference with the floor when the foot deck section is lowered to a generally vertical position.

In the prior art, when the foot deck section is lowered, the foot-end of the foot deck section is retracted to minimize the bed seat height. Varying the size of the deck can require complex combinations of mechanical and electrical components to be integrated into a bed.

SUMMARY

According to the present disclosure, a patient support apparatus is disclosed. The patient support apparatus has a bed frame, a pair of cross links moveable between a plurality of positions relative to the bed frame, and an adjustable deck positioned over the cross links and defining a foot support surface. The bed frame includes a head end, a foot end, and a longitudinal axis extending between the head end and the foot end. The foot support surface has a length dimension defined along the longitudinal axis of the bed frame and a width dimension defined transverse to the longitudinal axis. The length dimension is a first length and the width dimension is a first width when the cross links are in a first position, and the length dimension is a second length and the width dimension is a second width when the cross links are in a second position. The second length is less than the first length, and the second width is greater than the first width.

In some embodiments, the cross links may be arranged in a crisscross pattern. In some embodiments, the patient support apparatus may further include an actuator coupled to at least one of the cross links, and the actuator may be configured to move the cross links between the plurality of positions. Additionally, in some embodiments, the actuator may have an extended position and a retracted position, and the actuator may be coupled to each of the cross links such that when the actuator is extended the cross links are in the first position and when the actuator is retracted the cross links are in the second position.

In some embodiments, the patient support apparatus may further include a pair of telescopic arms pivotably coupled to the foot end of the bed frame and moveably coupled to each of the cross links. The pair of telescopic arms may be moveable between an extended position and a retracted position as the cross links move between the first position and the second position. In some embodiments, the patient support apparatus may further include a first support arm extending transverse to the longitudinal axis and coupled to a head end of each of the telescopic arms and a second support arm extending transverse to the longitudinal axis and coupled to a foot end of each of the telescopic arms.

In some embodiments, each of the cross links may include a first slot defined in a first end that receives one of a pair of second pins extending upwardly from the second support arm and a second slot defined in a second end that receives a first pin extending upwardly from the head end of each of the telescopic arms such that each of the cross links pivots relative to the telescopic arms and the second support arm as the cross links move between the first position and the second position. Additionally, in some embodiments, the patient support apparatus may further include a rotating link coupled to the second support arm at a point along the longitudinal axis of the bed frame and coupled to a first cross link of the cross links at a point equidistant from a point where the cross links intersect and the first end of the first cross link.

In some embodiments, the adjustable deck may include a first deck section and a second deck section. The first deck section and the second deck section may cooperate to define the length dimension of the foot support surface. The second deck section may move relative to the first deck section as the cross links move between the first position and the second position such that the length dimension is decreased from the first length to the second length.

In some embodiments, the adjustable deck may further include a third deck section and a fourth deck section. The third deck section and the fourth deck section may cooperate with the first deck section to define the width dimension of the foot support surface. The third deck section and the fourth deck section may move relative to the first deck section as the cross links move between the first position and the second position such that the width dimension is increased from the first width to the second width.

Additionally, in some embodiments, the third deck section may be hinged to a first side of the first deck section and the fourth deck section is hinged to a second side of the first deck section. The cross links may act on the third deck section and the fourth deck section to move each of the third deck section and the fourth deck section from a lowered position to a raised position as the cross links move between the first position and the second position.

According to another aspect, the patient support apparatus has a bed frame including a head end, a foot end, and a longitudinal axis extending between the head end and the foot end. The patient support apparatus also includes an adjustable foot section coupled to the foot end of the bed frame that is moveable between a plurality of positions relative to the foot end. The patient support apparatus further includes a deck moveably coupled to the adjustable foot section. The deck defines a foot support surface having a length dimension defined along the longitudinal axis of the bed frame and a width dimension defined transverse to the longitudinal axis. The length dimension is a first length and the width dimension is a first width when the adjustable foot section is in a first position, and the length dimension is a second length and the width dimension is a second width when the adjustable foot section is in a second position. The second length is less than the first length, and the second width is greater than the first width.

In some embodiments, the adjustable foot section may include a pair of cross links arranged in a crisscross pattern. The crisscross pattern may have a first dimension defined along the longitudinal axis of the bed frame that is decreased as the adjustable foot section is moved between the first position and the second position and a second dimension defined transverse to the longitudinal axis that is increased as the adjustable foot section is moved between the first position and the second position.

In some embodiments, the patient support apparatus may further include an actuator coupled to the pair of cross links. The actuator may be configured to move the adjustable foot section between the plurality of positions relative to the foot end of the bed frame. Additionally, in some embodiments, the actuator may have a retracted position and an extended position. The actuator may be coupled to the pair of cross links at a point where the cross links intersect such that when the actuator is extended the adjustable foot section is in the first position and when the actuator is retracted the adjustable foot section is in the second position.

In some embodiments, the adjustable foot section may further include a pair of telescopic arms pivotably coupled to the foot end of the bed frame. Each of the cross links may be moveably coupled to each of the telescopic arms. In some embodiments, each of the telescopic arms may include a first pin extending from a head end. Each of the cross links may include a first slot defined in a first end. Each of the first pins may be received in each of the first slots such that each of the cross links pivots relative to the each of the telescopic arms as the adjustable foot section is moved between the first position and the second position.

In some embodiments, the deck may include a first deck section and a second deck section. The second deck section may move between an extended position and a retracted position as the adjustable foot section moves between the first position and the second position. The first deck section and the second deck section may cooperate to define the length dimension of the foot support surface such that when the second deck section is in the extended position the length dimension is the first length and when the second deck section is in the retracted position the length dimension is the second length.

In some embodiments, the deck may further include a third deck section and a fourth deck section. Each of the third deck section and the fourth deck section may move between a lowered position and a raised position relative to the first deck section as the adjustable foot section moves between the first position and the second position. The first deck section, the third deck section, and the fourth deck section may cooperate to define the width dimension of the foot support surface such that when each of the third deck section and the fourth deck section is in the lowered position the width dimension is the first width and when each of the third deck section and the fourth deck section is in the raised position the width dimension is the second width.

In some embodiments, the third deck section may be hinged to a first side of the first deck section and the fourth deck section may be hinged to a second side of the first deck section positioned opposite the first side.

DETAILED DESCRIPTION OF THE DRAWINGS

Figure 1:
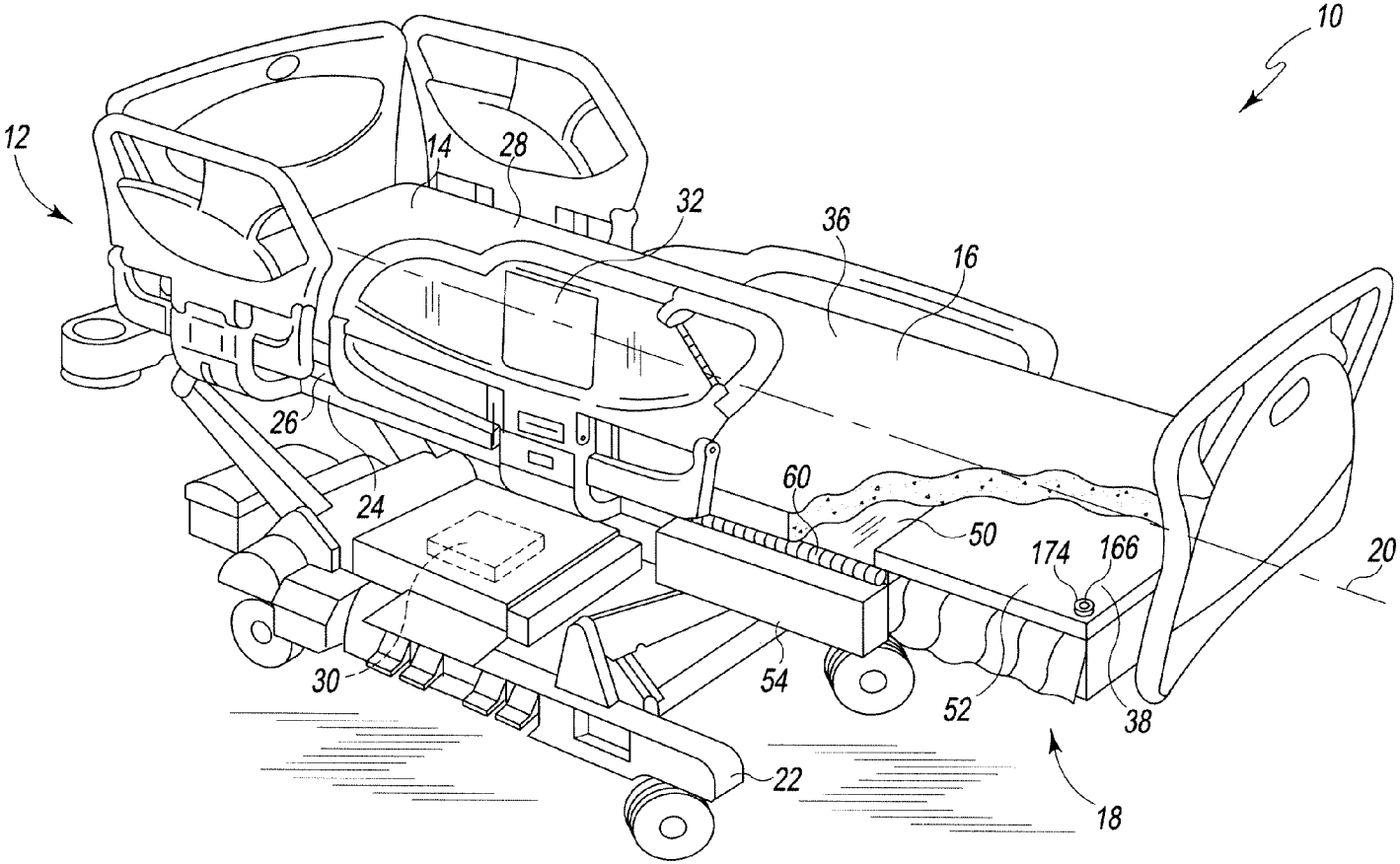
FIG. 1 is a perspective view of a patient support apparatus including an adjustable foot section.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but, on the contrary, the intention is to cover all modifications, equivalents, and alternatives falling within the spirit and scope of the invention as defined by the appended claims.

Referring now to FIG. 1, there is shown a patient support apparatus embodied as a chair bed 10. The chair bed 10 includes a bed frame 12 having a head end 14 and a foot end 16 and an adjustable foot section 18 pivotably coupled to foot end 16 of the bed frame 12. A longitudinal axis 20 extends along the centerline of the bed frame 12 between the head end 14 and the foot end 16. The bed frame 12 has a base 22, an intermediate frame 24 positioned above the base 22, and a deck 26 positioned above the intermediate frame 24.

The bed frame 12 includes a lift mechanism to raise and lower the intermediate frame 24 relative to the base 22 and a head articulation mechanism to raise and lower a head and/or upper torso section 28 of the deck 26, and a foot articulation mechanism (see FIGS. 6-8) to raise and lower the adjustable foot section 18. As such, the chair bed 10 is configured to assume a variety of positions, including a horizontal position, a chair-like position, Trendelenburg, reverse Trendelenburg, and/or other positions. The chair bed 10 includes a controller 30 configured to control the operation of each of those articulation mechanisms based on the user input received via a user interface 32.

A mattress assembly 36 is supported by the deck 26 of the bed frame 12 and a deck 38 of the adjustable foot section 18. The mattress assembly 36 includes a cover defining an interior region in which a variety of support components such as air bladders, foam, three-dimensional thermoplastic fibers, and/or other support elements may be arranged. In the illustrated embodiment, air bladders are configured to provide one or more therapeutic services to a person positioned on the mattress assembly 36.

Figure 2:
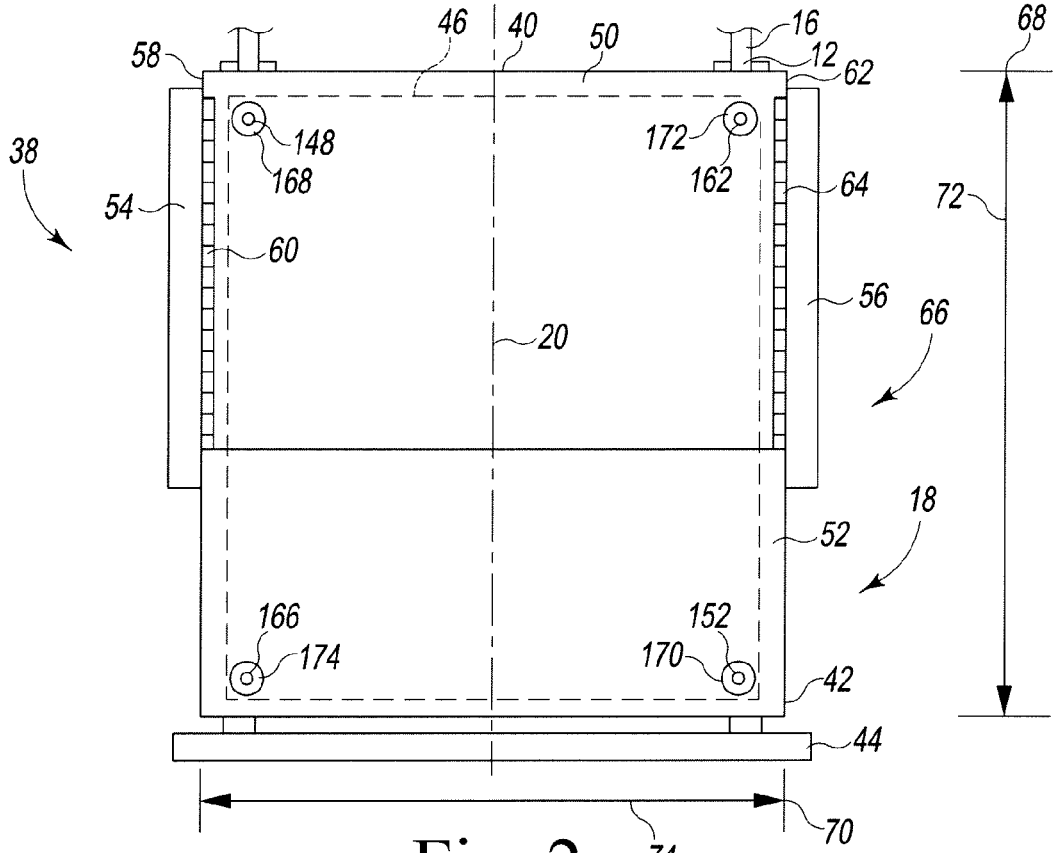
FIG. 2 is a top plan view of the foot section of FIG. 1 in one position.
Figure 3:
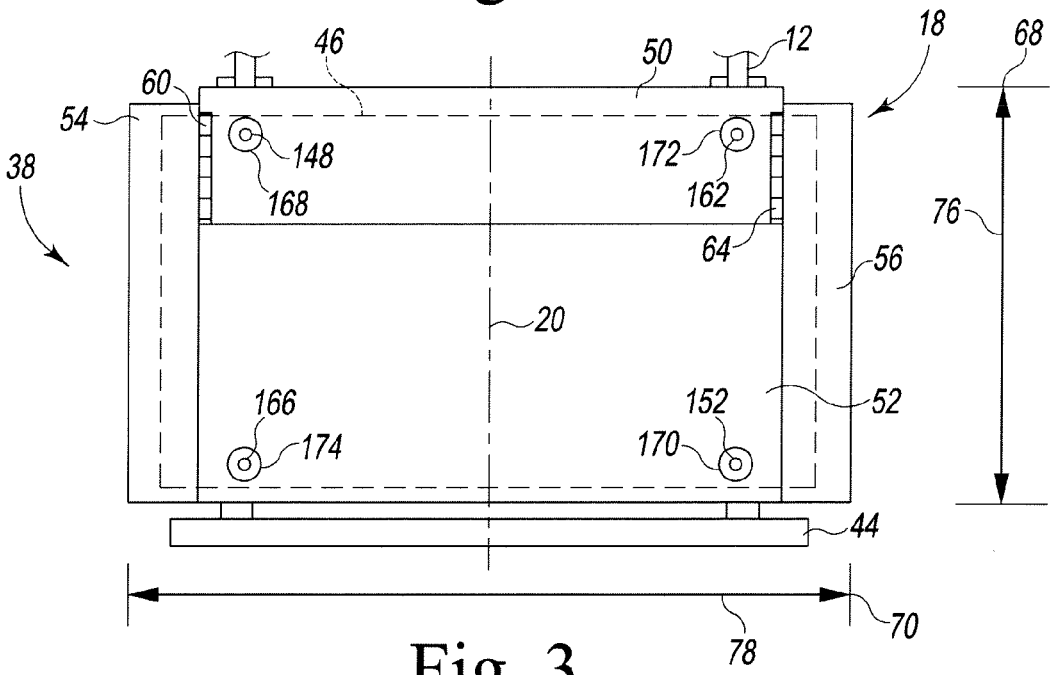
FIG. 3 is a top plan view of the foot section of FIG. 1 in another position.

Referring now to FIGS. 2 and 3, the adjustable foot section 18 is shown with the mattress assembly 36 removed. The adjustable foot section 18 has a head end 40, which is pivotably coupled to the foot end 16 of the bed frame 12, and a foot end 42 having a foot board 44 secured thereto. The adjustable foot section 18 also includes an adjustment mechanism 46, and the deck 38 is positioned over the adjustment mechanism 46. The deck 38 of the adjustable foot section 18 includes a fixed deck section 50 and a sliding deck section 52. As will be described in greater detail below, the adjustment mechanism 46 acts on the sliding deck section 52 to move the sliding deck section 52 relative to the foot end 16 of the bed frame 12 between the extended position shown in FIG. 2 and the retracted position shown in FIG. 3. It will be appreciated that in other embodiments both deck sections 50, 52 may be configured to move relative to the foot end 16 of the bed frame 12.

The deck 38 also includes a side deck section 54 and a side deck section 56. The side deck section 54 is pivotably coupled to a side panel 58 of the fixed deck section 50 via a hinge joint 60. The side deck section 56 is also pivotably coupled to another side panel 62 of the fixed deck section 50 via a hinge joint 64. In that way, the side deck sections 54, 56 are configured to rotate relative to the fixed deck section 50 between the lowered positions shown in FIG. 2 and the raised positions shown in FIG. 3. As will be described in greater detail below, the adjustment mechanism 46 acts on the side deck sections 54, 56 to move those sections between their respective lowered and raised positions. As shown in FIGS. 2 and 3, each of the hinge joints 60, 64 is embodied as a single rotating hinge extending along the side panels 58, 62; it will be appreciated that in other embodiments more than one hinge may be used for each hinge joint.

The deck sections 50, 52, 54, 56 define a foot support surface 66 having a length dimension 68 extending along the longitudinal axis 20 and a width dimension 70 extending transverse to the longitudinal axis 20. When the sliding deck section 52 is extended and the side deck sections 54, 56 are lowered, the length dimension 68 extends a length 72 and the width dimension 70 extends a width 74, as shown in FIG. 2. When the sliding deck section 52 is retracted and the side deck sections 54, 56 are raised, the length dimension 68 is decreased to a length 76 while the width dimension 70 is increased to a width 78, as shown in FIG. 3. In that way, the foot support surface 66 becomes wider and shorter as the foot end 42 of the adjustable foot section 18 is moved toward the bed frame 12 and becomes narrower and longer as the foot end 42 of the adjustable foot section 18 is moved away from the bed frame 12.

Figure 4:
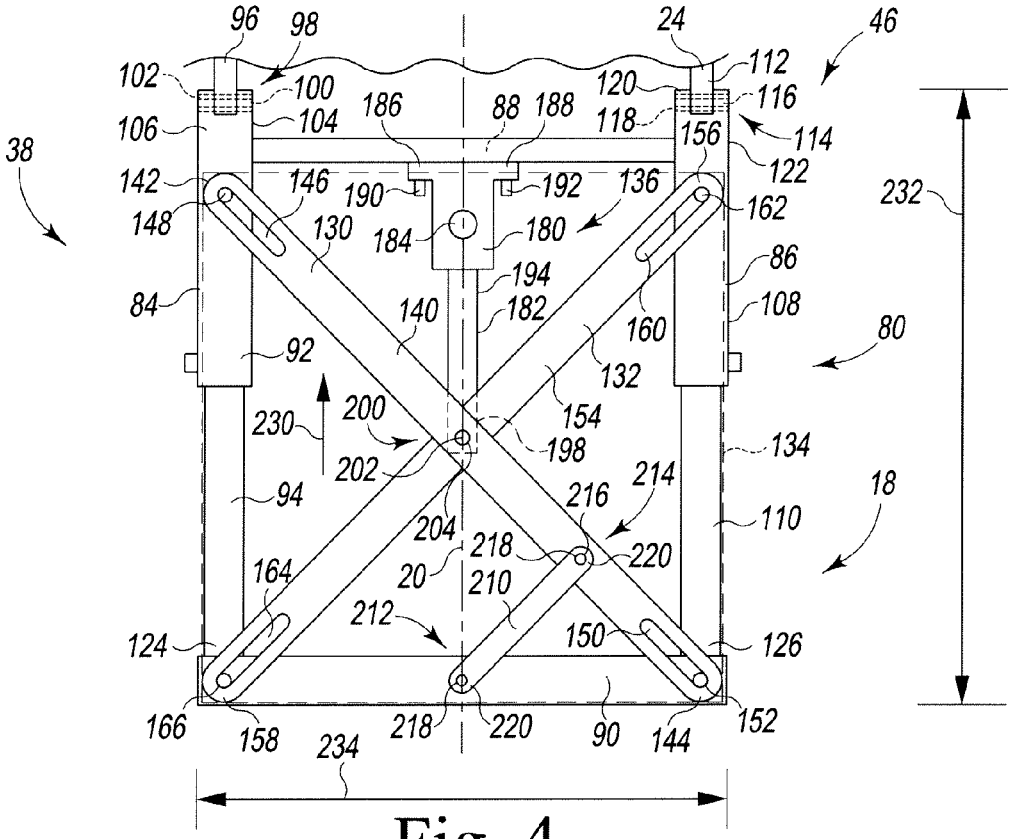
FIG. 4 is a top plan view of one embodiment of an adjustment mechanism of the foot section of FIG. 1 in the position corresponding to the one shown in FIG. 2.
Figure 5:
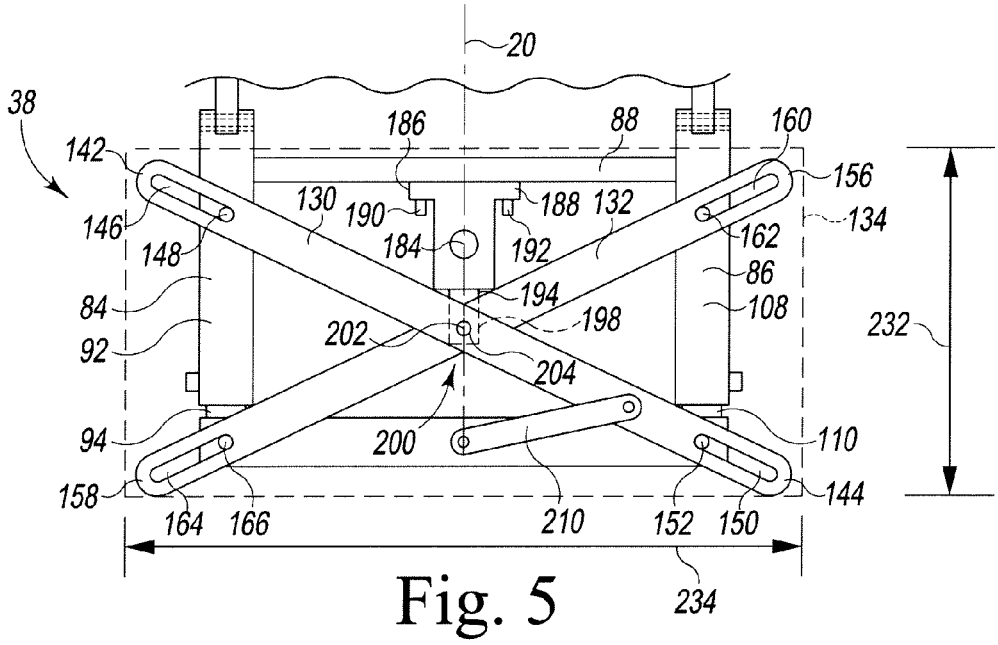
FIG. 5 is a top plan view of the adjustment mechanism of FIG. 4 in the position corresponding to the one shown in FIG. 3.

Referring now to FIGS. 4 and 5, the deck 38 is removed, and an illustrative embodiment of the adjustment mechanism 46 is shown in greater detail. The adjustment mechanism 46 has a base frame 80 that includes a pair of telescopic arms 84, 86 pivotably coupled to the intermediate frame 24 and a pair of support beam 88, 90 extending therebetween. The telescopic arm 84 includes a pair of arm sections 92, 94 that are moveable relative to one another. Specifically, an end of arm section 94 is received into, and telescopes with, an end of the arm section 92. The arm section 92 of the arm 84 is coupled to a mounting arm 96 extending from the bed frame 12 at a pivot joint 98. As shown in FIG. 4, the pivot joint 98 includes a cylindrical pivot pin 100 that extends through, and is received in, a hole 102 defined in the mounting arm 96 and a clevis 104 formed at an end 106 of arm section 92.

The telescopic arm 86 also includes a pair of arm sections 108, 110 that are moveable relative to one another. Specifically, an end of arm section 110 is received into, and telescopes with, an end of the arm section 108. The arm section 108 of the arm 86 is coupled to another mounting arm 112 extending from the bed frame 12 at a pivot joint 114. The pivot joint 114, like the pivot joint 98, includes a cylindrical pivot pin 116 that is received by a hole 118 defined in the mounting arm 112 and a clevis 120 formed at an end 122 of arm section 108. It will be appreciated that in other embodiments the pivot joints 98, 114 may include any combination of holes, pins, rods, and other structures necessary to pivotably couple the arms 84, 86 (and thus the adjustable foot section 18) to the bed frame 12.

The support beam 88, which extends transverse to the longitudinal axis 20 of the bed frame 12, is secured to the end 106 of the arm section 92 and the end 122 of the arm section 108. The support beam 90, which similarly extends transverse to the longitudinal axis 20 of the bed frame 12, is secured to an end 124 of the arm section 94 and the end 126 of the arm section 110. In that way, the support beam 88, 90 join the pair of telescopic arms 84, 86, thereby forming the base frame 80.

The adjustment mechanism 46 also includes a pair of cross links 130, 132 arranged in a crisscross pattern 134 on the base frame 80 and an linear actuator 136 configured to move the adjustment mechanism 46 between the elongated position shown in FIG. 4 and the condensed position shown in FIG. 5. The cross link 130 includes a rod 140 extending from a link end 142 positioned adjacent to the end 106 of the arm section 92 to an opposite link end 144. A rectangular slot 146 is defined in the link end 142 of the cross link 130 and is sized to receive a pin 148 extending upwardly from the arm section 92 of the arm 84. Another rectangular slot 150 is defined in the link end 144 of the cross link 130 and is also sized to receive a pin 152 extending upwardly from the support beam 90. As the adjustment mechanism 46 moves between the elongated position and the condensed position, the slots 146, 150 slide and pivot relative the pins 148, 152.

The cross link 132 also includes a rod 154 extending from a link end 156 positioned adjacent to the end 122 of the arm section 108 to an opposite link end 158. A rectangular slot 160 is defined in the link end 156 of the cross link 132 and is sized to receive a pin 162 extending upwardly from the arm section 108 of the arm 86. Another rectangular slot 164 is defined in the link end 158 of the cross link 132 and is also sized to receive a pin 166 extending upwardly from the support beam 90. As the adjustment mechanism 46 moves between the elongated position and the condensed position, the slots 160, 164 slide and pivot relative to the pins 162, 166.

As shown in FIGS. 2 and 3, the pins 148, 162 extend through openings defined in the fixed deck section 50 while the pins 152, 166 extend through openings defined in the sliding deck section 52. In the illustrative embodiment, the pins 148, 152, 162, 166 are externally-threaded rods sized to receive corresponding internally-threaded nuts 168, 170, 172, 174. In that way, the pins 148, 152, 162, 166 couple the deck 38 to the adjustment mechanism 46. It will be appreciated that in other embodiments other fasteners may be used to couple the deck 38 to the adjustment mechanism 46.

Returning to FIGS. 4 and 5, the linear actuator 136 includes a housing 180 having a rod 182 extending outwardly therefrom and an electric motor 184 coupled to the housing 180. The housing 180 has a pair of flanges 186, 188 that are secured to the support beam 88 via a pair of fasteners 190, 192. The rod 182 includes a piston 194 that extends from the housing 180 to an end 198. The cross links 130, 132 are coupled to the end 198 of the piston 194 at a pivot joint 200 located at the intersection of the cross links 130, 132. As shown in FIGS. 4 and 5, the pivot joint 200 is also positioned on the longitudinal axis 20 of the bed frame 12. The pivot joint 200 includes a cylindrical pivot pin 202 that extends through, and is positioned in, a pair of holes 204 defined in the cross links 130, 132, respectively, and a hole (not shown) defined in the end 198.

The electric motor 184 is electrically coupled to the controller 30 of the chair bed 10, and the controller 30 controls the operation of the motor 184. The motor 184 is configured to extend and retract the piston 194 relative to the housing 180, thereby causing the adjustment mechanism 46 to move between the elongated position shown in FIG. 4 and the condensed position shown in FIG. 5. It will be appreciated that in other embodiments the linear actuator 136 may use servos, hydraulics, or pneumatics in place of, or in addition to, the electric motor 184.

The adjustment mechanism 46 further includes a rotating link 210 extending between the support beam 90 and the cross link 130. The rotating link 210 is pivotably coupled to the support beam 90 at a pivot joint 212 positioned on the longitudinal axis 20 of the bed frame 12 and is pivotably coupled to the cross link 130 at a pivot joint 214. The pivot joint 214 is located at a point 218 equidistant from the link end 144 of the cross link 130 and the pivot joint 200. Each of the pivot joints 212, 214 includes a cylindrical pivot pin 216 that extends through, and is positioned in, a pair of holes 220 defined in the cross link 130 and the support beam 90, respectively.

In operation, the adjustable foot section 18 may be placed in any location between the elongated or extended position shown in FIGS. 2 and 4 and the condensed or retracted position shown in FIGS. 3 and 5. To move the adjustable foot section 18 from the elongated position to the condensed position, a user may access the user interface 32 and command the controller 30 to activate the electric motor 184. The electric motor 184 causes the piston 194 to retract into the housing 180. As the piston 194 is retracted, the pivot joint 200 is moved in the direction indicated by arrow 230, and the cross links 130, 132 rotate about the pivot joint 200 as the slots 146, 150, 160, 164 defined in the cross links 130, 132 slide and pivot about the pins 148, 152, 162, 166.

As shown in FIGS. 4 and 5, the crisscross pattern 134 of the cross links 130, 132 has a dimension 232 extending along the longitudinal axis 20 that is decreased as the piston 194 is retracted. The change in the dimension 232 results from the decreased distance between the link end 142 of the cross link 130 and the link end 158 of the cross link 132, and the decreased distance between the link end 156 of the cross link 132 and the link end 144 of the cross link 130. As the link end 142, 158 are moved closer to one another, the arm section 94 of the arm 84 is drawn into the arm section 92. Similarly, as the link end 144, 156 are moved closer to one another, the arm section 110 of the arm 86 is drawn into the arm section 108.

The movement of the arm sections 92, 94 and the arm sections 108, 110 causes the support beam 90 to move toward the foot end 16 of the bed frame 12 and thereby move the pins 152, 166 extending upwardly from the support beam 90 toward the foot end 16. Because the sliding deck section 52 is coupled to the adjustable foot section 18 via the pins 152, 166, the movement of the pins 152, 166 toward the foot end 16 of the bed frame 12 causes the sliding deck section 52 to move from the extended position to the retracted position. In that way, the length dimension 68 of the support surface 66 decreases from the length 72 shown in FIG. 2 to the length 76 shown in FIG. 3.

Figure 7:
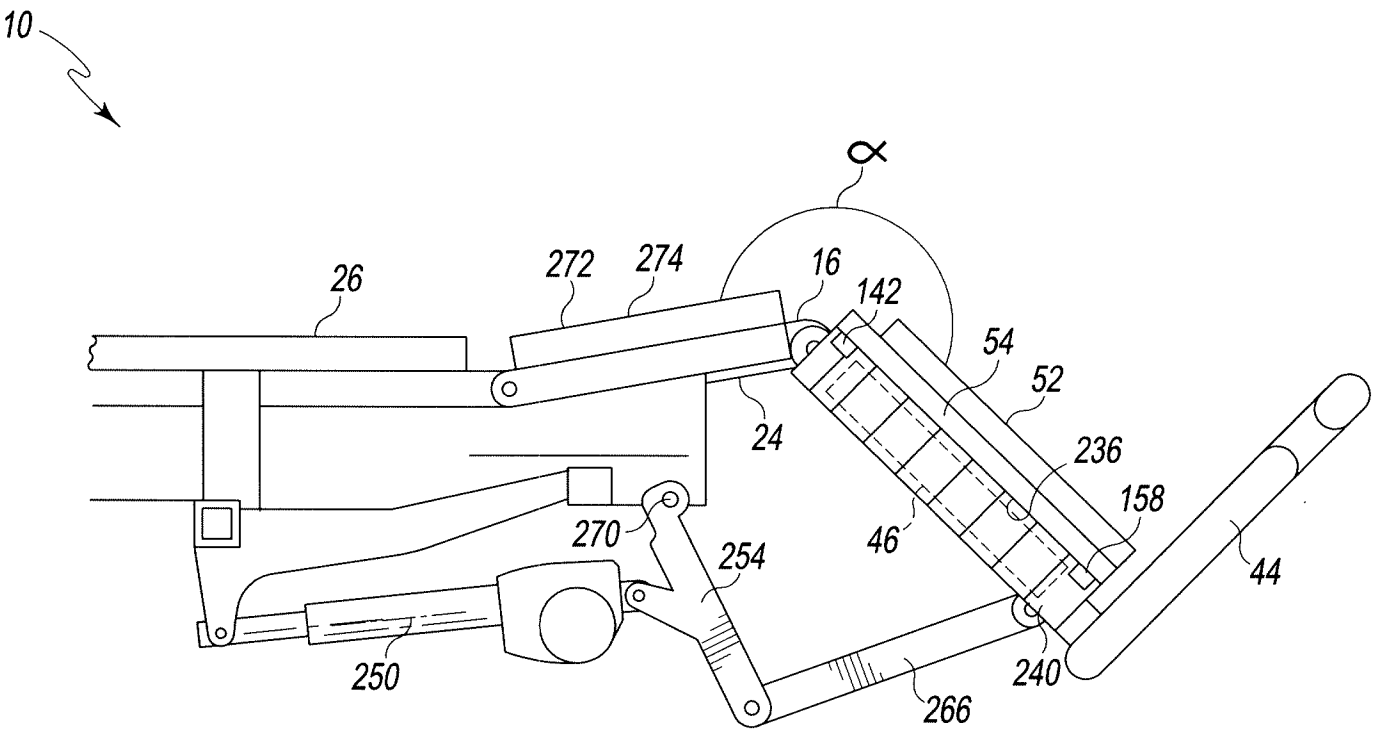
FIG. 7 is a diagrammatic representation similar to FIG. 6 with the surface of the foot section in an angled position.
Figure 8:
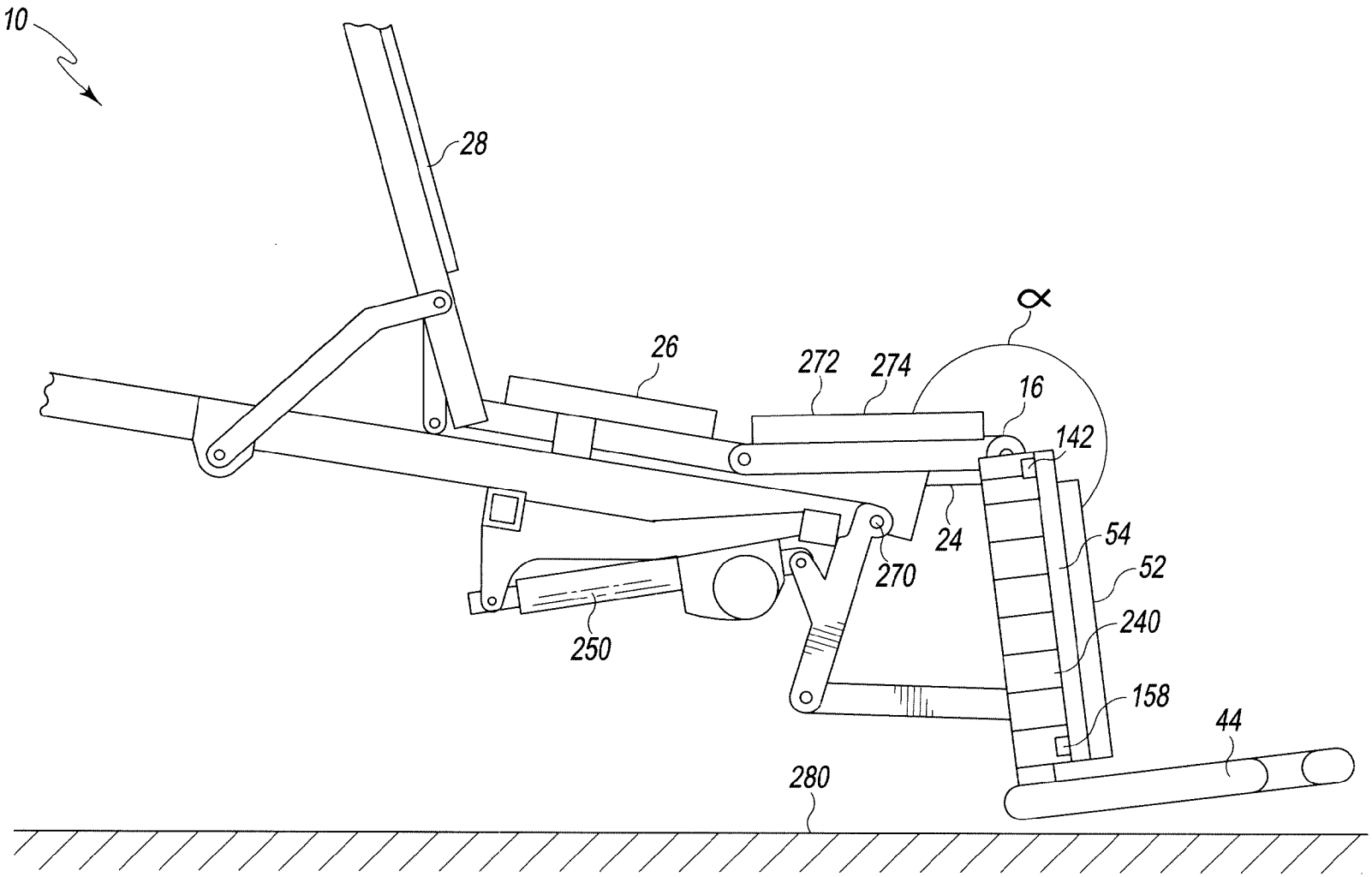
FIG. 8 is a diagrammatic representation similar to FIG. 6 with the surface of the foot section in a lowered position.

As shown in FIGS. 4 and 5, the crisscross pattern 134 has another dimension 234 extending transverse to the longitudinal axis 20 that is increased as the piston 194 is retracted. The change in the dimension 234 results from the increased distance between the link end 142 of the cross link 130 and the link end 156 of the cross link 132, and the increased distance between the link end 144 of the cross link 130 and the link end 158 of the cross link 132. As the link ends 142, 158 of the cross links 130, 132 move outward, the link ends 142, 158 engage with the inner surface 236 (see FIG. 7) of the side deck section 54 and push on the side deck section 54, thereby causing the side deck section 54 to rotate from the lowered position to the raised position. As shown in FIGS. 7 and 8, the link ends 142, 158 support the side deck section 54 in the raised position. Similarly, as the link ends 144, 156 of the cross links 130, 132 move outward, the link ends 144, 158 engage with the inner surface (not shown) of the side deck section 56 and push on the side deck section 56, thereby causing the side deck section 56 to rotate from the lowered position to the raised position. The link ends 144, 156 also support the side deck section 56 in the raised position. When both of the side deck sections 56 are in the raised position, the width dimension 70 is the width 78 shown in FIG. 3.

Figure 6:
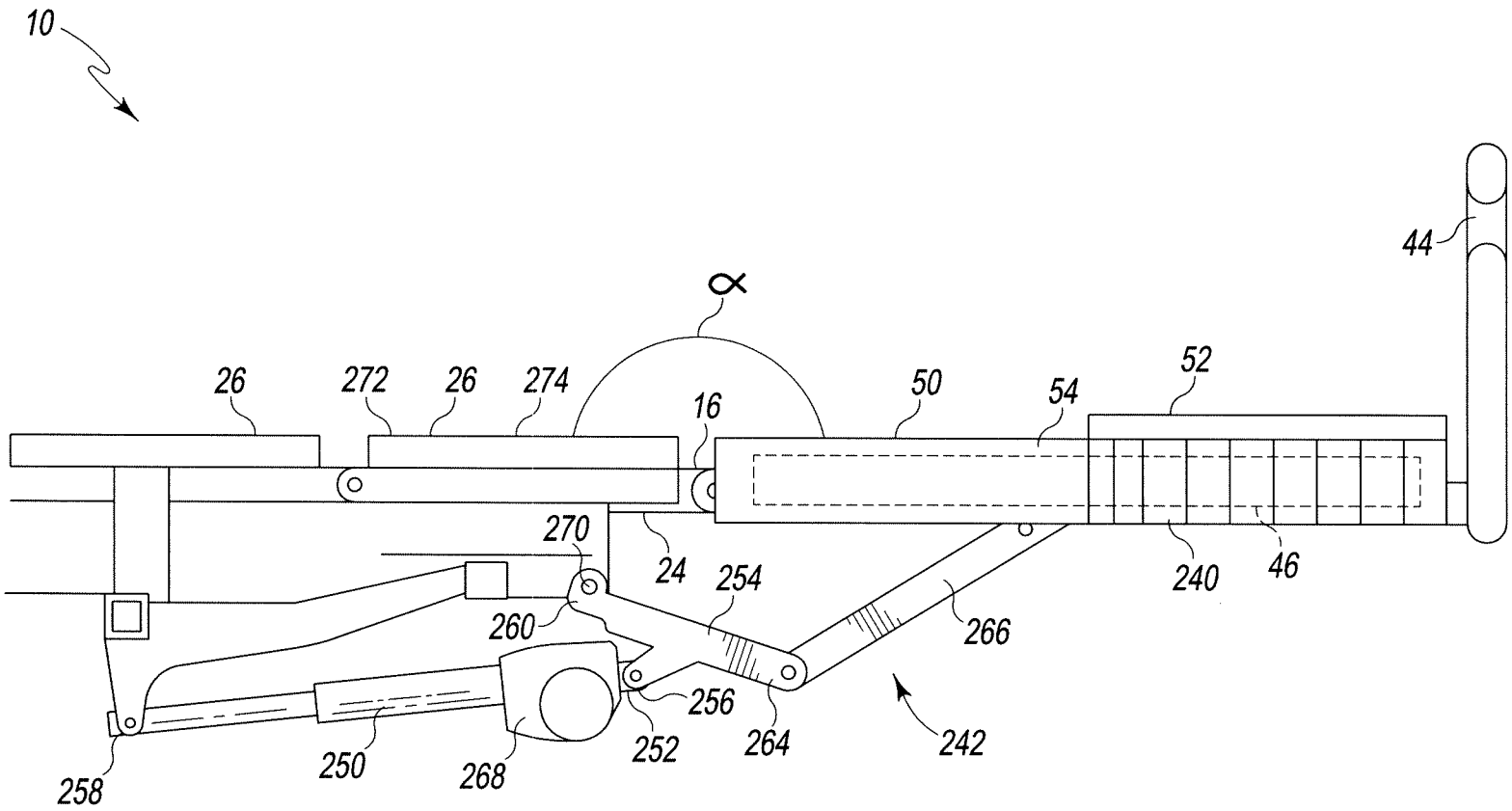
FIG. 6 is a diagrammatic representation of the patient support apparatus of FIG. 1 with the foot section in a raised position.

Referring now to FIGS. 6-8, the foot section 18 is shown in a number of positions relative to the chair bed 10, and the adjustment mechanism 46 is positioned behind the side deck section 54 and an adjustable curtain 240 secured to underside of the deck 38. Adjusting the length and width of the foot section 18 may be used to modify the length of the chair bed 10 to accommodate patients of different heights, or may be used to retract the foot section 18 when the foot section 18 is moved to a generally vertical position as shown in FIG. 8. As shown in FIGS. 6-8, the chair bed 10 includes a foot articulation mechanism 242 that pivots the foot section 18 relative to the intermediate frame 24. The mechanism 242 includes a linear actuator 250 having a rod 252 pivotably coupled to a crank 254 at a rod end 256 and the intermediate frame 24 at a rod end 258. The crank 254 includes an end 260 pivotably coupled to the intermediate frame 24 and an end 264 pivotably coupled to a support arm 266. The crank 254 supports the foot section 18 through the support arm 266, which is pivotally coupled to the arm 84 of the foot section 18. The rod 252, which extends and retracts relative to a body 268 of the actuator 250, acts on the crank 254, thereby causing the crank to rotate about an axis 270.

Operation of the linear actuator 250 causes the foot section 18 to move relative to a seat deck section 272 of the deck 26 such that a support surface 274 of the seat deck section 272 and the support surface 66 of the foot section 18 form a variable angle $\alpha$. The angle $\alpha$ is variable between the obtuse angle shown in FIG. 7 and the reflex angle shown in FIG. 8, with a straight angle being formed between the support surfaces 66, 274 when the foot section 18 is positioned to support a patient in a supine position on the chair bed 10, as shown in FIG. 6. As shown in FIG. 8, the angle $\alpha$ may be as great as approximately 270° when the foot section 18 is lowered to position the chair bed 10 in the chair egress position. In the chair egress position shown in FIG. 8, the foot section 18 is fully condensed to reduce the height necessary to separate the foot section 18 from the floor 280. In addition to being shorter, the support surface 66 is also wider when in the chair egress position shown in FIG. 8, thereby providing the patient with additional support while getting into and out of the chair bed 10.

While the disclosure has been illustrated and described in detail in the drawings and foregoing description, such an illustration and description is to be considered as exemplary and not restrictive in character, it being understood that only illustrative embodiments have been shown and described and that all changes and modifications that come within the spirit of the disclosure are desired to be protected. For example, while actuator 136 of the adjustment mechanism 40 is shown connected to the pair of cross links 130, 132, in other embodiments the actuator 136 may be connected to only one of the cross links. In such embodiments, the actuator 136 may be connected to an end of the cross link. Additionally, each of the telescopic arms 84, 86 may be replaced by one or more linear actuators that would provide the motive force necessary to move the foot section 18. In such embodiments, the actuator 136 may be eliminated.

While the side deck sections 54, 56 are shown hinged to the fixed deck section 50, the side deck sections 54, 56 may instead be configured to slide relative to the fixed deck section 50 between extended and retracted positions. The cross links 130, 132 and the deck sections 54, 56 may include any pins, slots, or other structures necessary to permit the cross links 130, 132 to act on the deck sections 54, 56.

Although certain illustrative embodiments have been described in detail above, variations and modifications exist within the scope and spirit of this disclosure as described and as defined in the following claims.

The invention claimed is:

1. A patient support apparatus comprising a bed frame including a head end, a foot end, and a longitudinal axis extending between the head end and the foot end, a pair of cross links moveable between a plurality of positions relative to the bed frame, and an adjustable deck positioned on the cross links and defining a foot support surface having a length dimension defined along the longitudinal axis of the bed frame and a width dimension defined transverse to the longitudinal axis, wherein (i) the length dimension is a first length and the width dimension is a first width when the cross links are in a first position, (ii) the length dimension is a second length and the width dimension is a second width when the cross links are in a second position, (iii) the second length is less than the first length, and (iv) the second width is greater than the first width, wherein the cross links are arranged in a crisscross pattern.

2. The patient support apparatus of claim 1, further comprising an actuator coupled to at least one of the cross links, the actuator being configured to move the cross links between the plurality of positions.

3. The patient support apparatus of claim 2, wherein the actuator has an extended position and a retracted position, and the actuator is coupled to each of the cross links such that (i) when the actuator is extended the cross links are in the first position and (ii) when the actuator is retracted the cross links are in the second position.

4. The patient support apparatus of claim 2, further comprising a pair of telescopic arms pivotably coupled to the foot end of the bed frame and moveably coupled to each of the cross links, the pair of telescopic arms being moveable between an extended position and a retracted position as the cross links move between the first position and the second position.

5. The patient support apparatus of claim 4, further comprising a first support arm extending transverse to the longitudinal axis and coupled to a head end of each of the telescopic arms and a second support arm extending transverse to the longitudinal axis and coupled to a foot end of each of the telescopic arms.

6. The patient support apparatus of claim 5, wherein each of the cross links includes (i) a first slot defined in a first end that receives a pin extending upwardly from the second support arm and (ii) a second slot defined in a second end that receives a pin extending upwardly from the head end of one of the telescopic arms such that each of the cross links pivots relative to the telescopic arms and the second support arm as the cross links move between the first position and the second position.

7. The patient support apparatus of claim 6, further comprising a rotating link coupled to the second support arm at a point along the longitudinal axis of the bed frame and coupled to a first cross link of the cross links at a point equidistant from a point where the cross links intersect and the first end of the first cross link.

8. The patient support apparatus of claim 1, wherein the adjustable deck comprises a first deck section and a second deck section, the first deck section and the second deck section cooperating to define the length dimension of the foot support surface, and the second deck section moving relative to the first deck section as the cross links move between the first position and the second position such that the length dimension is decreased from the first length to the second length.

9. The patient support apparatus of claim 1, wherein the adjustable deck further comprises a third deck section and a fourth deck section, the third deck section and the fourth deck section (i) cooperating with the first deck section to define the width dimension of the foot support surface and (ii) moving relative to the first deck section as the cross links move between the first position and the second position such that the width dimension is increased from the first width to the second width.

10. The patient support apparatus of claim 9, wherein the third deck section is hinged to a first side of the first deck section and the fourth deck section is hinged to a second side of the first deck section, and the cross links act on the third deck section and the fourth deck section to move each of the third deck section and the fourth deck section from a lowered position to a raised position as the cross links move between the first position and the second position.

11. A patient support apparatus comprising a bed frame including a head end, a foot end, and a longitudinal axis extending between the head end and the foot end, an adjustable foot section coupled to the foot end of the bed frame, the adjustable foot section being moveable between a plurality of positions relative to the foot end, and a deck moveably coupled to the adjustable foot section, the deck defining a foot support surface having a length dimension defined along the longitudinal axis of the bed frame and a width dimension defined transverse to the longitudinal axis, wherein (i) the length dimension is a first length and the width dimension is a first width when the adjustable foot section is in a first position, (ii) the length dimension is a second length and the width dimension is a second width when the adjustable foot section is in a second position, (iii) the second length is less than the first length, and (iv) the second width is greater than the first width, wherein the adjustable foot section comprises a pair of cross links arranged in a crisscross pattern, and the crisscross pattern has (i) a first dimension defined along the longitudinal axis of the bed frame that is decreased as the adjustable foot section is moved between the first position and the second position and (ii) a second dimension defined transverse to the longitudinal axis that is increased as the adjustable foot section is moved between the first position and the second position.

12. The patient support apparatus of claim 10, further comprising an actuator coupled to the pair of cross links, the actuator being configured to move the adjustable foot section between the plurality of positions relative to the foot end of the bed frame.

13. The patient support apparatus of claim 12, wherein the actuator has a retracted position and an extended position, and the actuator is coupled to the pair of cross links at a point where the cross links intersect such that (i) when the actuator is extended the adjustable foot section is in the first position and (ii) when the actuator is retracted the adjustable foot section is in the second position.

14. The patient support apparatus of claim 10, wherein the adjustable foot section further comprises a pair of telescopic arms pivotably coupled to the foot end of the bed frame, and each of the cross links is moveably coupled to each of the telescopic arms.

15. The patient support apparatus of claim 14, wherein each of the telescopic arms includes a pin extending from a head end, each of the cross links includes a first slot defined in a first end, and the pin of one of telescopic arms is received in the first slot of one of the cross links such that each of the links pivots relative to the each of the telescopic arms as the adjustable foot section is moved between the first position and the second position.

16. The patient support apparatus of claim 10, wherein the deck comprises a first deck section and a second deck section, the second deck section moving between an extended position and a retracted position as the adjustable foot section moves between the first position and the second position, and the first deck section and the second deck section cooperate to define the length dimension of the foot support surface such that (i) when the second deck section is in the extended position the length dimension is the first length and (ii) when the second deck section is in the retracted position the length dimension is the second length.

17. The patient support apparatus of claim 16, wherein the deck further comprises a third deck section and a fourth deck section, each of the third deck section and the fourth deck section moving between a lowered position and a raised position relative to the first deck section as the adjustable foot section moves between the first position and the second position, and the first deck section, the third deck section, and the fourth deck section cooperating to define the width dimension of the foot support surface such that when each of the third deck section and the fourth deck section is in the lowered position the width dimension is the first width and when each of the third deck section and the fourth deck section is in the raised position the width dimension is the second width.

18. The patient support apparatus of claim 17, wherein the third deck section is hinged to a first side of the first deck section and the fourth deck section is hinged to a second side of the first deck section positioned opposite the first side.

19. A patient support apparatus comprising a bed frame including a head end, a foot end, and a longitudinal axis extending between the head end and the foot end, a pair of cross links moveable between a plurality of positions relative to the bed frame, and an adjustable deck positioned on the cross links and defining a foot support surface having a length dimension defined along the longitudinal axis of the bed frame and a width dimension defined transverse to the longitudinal axis, wherein (i) the length dimension is a first length and the width dimension is a first width when the cross links are in a first position, (ii) the length dimension is a second length and the width dimension is a second width when the cross links are in a second position, (iii) the second length is less than the first length, and (iv) the second width is greater than the first width, wherein the adjustable deck comprises a first deck section and a second deck section, the first deck section and the second deck section cooperating to define the length dimension of the foot support surface, and the second deck section moving relative to the first deck section as the cross links move between the first position and the second position such that the length dimension is decreased from the first length to the second length, wherein the adjustable deck further comprises a third deck section and a fourth deck section, the third deck section and the fourth deck section (i) cooperating with the first deck section to define the width dimension of the foot support surface and (ii) moving relative to the first deck section as the cross links move between the first position and the second position such that the width dimension is increased from the first width to the second width, wherein the third deck section is hinged to a first side of the first deck section and the fourth deck section is hinged to a second side of the first deck section, and the cross links act on the third deck section and the fourth deck section to move each of the third deck section and the fourth deck section from a lowered position to a raised position as the cross links move between the first position and the second position.

* * * * *